US005749702A

United States Patent [19]

Datta et al.

[11] Patent Number: 5,749,702

[45] Date of Patent: May 12, 1998

[54] FAN FOR AIR HANDLING SYSTEM

[75] Inventors: Dipti Kr. Datta, Mississauga; Werner Richarz, Ottawa, both of Canada

[73] Assignee: Air Handling Engineering Ltd., Buffalo, N.Y.

[21] Appl. No.: 732,522

[22] Filed: Oct. 15, 1996

[51] Int. Cl.[6] ..... F04D 29/66

[52] U.S. Cl. ..... 415/119; 415/142; 415/185; 415/206; 415/208.2; 415/211.1

[58] Field of Search ..... 415/119, 142, 415/183, 185, 200, 204, 206, 208.1, 208.2, 211.1, 211.2, 213.1, 222, 223, 219.1, 228; 181/224, 225

[56] References Cited

U.S. PATENT DOCUMENTS

| | | | |
|---|---|---|---|
| 2,169,232 | 8/1939 | Flanders . | |
| 2,287,822 | 6/1942 | Odor et al. | 415/208.1 |
| 2,327,841 | 8/1943 | Hagen . | |
| 2,900,125 | 8/1959 | Quick | 415/211.2 |
| 3,070,287 | 12/1962 | Eck . | |
| 3,174,682 | 3/1965 | Wilfert et al. . | |
| 3,467,302 | 9/1969 | Wilson | 415/206 |
| 3,811,790 | 5/1974 | Mikulina et al. | 415/206 |
| 3,934,410 | 1/1976 | Williams . | |
| 3,995,970 | 12/1976 | Nobuyuki | 415/208.2 |
| 4,019,829 | 4/1977 | Knopfel et al. . | |
| 4,432,694 | 2/1984 | Kuroda et al. . | |
| 4,576,549 | 3/1986 | Lanier . | |
| 4,692,091 | 9/1987 | Ritenour . | |
| 4,787,818 | 11/1988 | Bales et al. | 415/206 |
| 4,895,489 | 1/1990 | Kohama et al. . | |
| 4,927,328 | 5/1990 | Scoates et al. . | |
| 5,066,194 | 11/1991 | Amr et al. . | |
| 5,096,013 | 3/1992 | Yoshida et al. . | |
| 5,110,266 | 5/1992 | Toyoshima et al. . | |
| 5,259,724 | 11/1993 | Liston et al. . | |
| 5,297,942 | 3/1994 | Fleishman et al. . | |
| 5,336,046 | 8/1994 | Hashimoto et al. . | |

FOREIGN PATENT DOCUMENTS

| | | | |
|---|---|---|---|
| 0595539 | 2/1978 | U.S.S.R. | 415/119 |

OTHER PUBLICATIONS

Catalogue No. 450–D dated Dec. 1993, published by Twin City Fan & Blower Co.

*Primary Examiner*—Christopher Verdier
*Attorney, Agent, or Firm*—Young & Basile, P.C.

[57] ABSTRACT

A fan unit for a building's air handling system comprising a support structure including a front wall with an air inlet opening formed therein and a bladed fan wheel rotatably mounted on the support structure about its central axis and having an axial air intake on a front side thereof confronting the inlet opening. The fan wheel has an annular air outlet extending about its circumference. A fixed centerbody directs air flow into and within the fan wheel and extends along the central axis from a relatively narrow front end located in the air inlet opening to a wider rear end located within the fan wheel. This centerbody has an annular exterior surface which curves outwardly in a section thereof adjacent the wider rear end. The centerbody extends through the axial air intake of the fan wheel. Support struts rigidly support the centerbody in a fixed position. Preferably the centerbody is filled with sound attenuating material. Preferably the fan unit has an additional wall spaced from the front wall and these two walls extend radially away from the annular air outlet forming an annular air passageway that opens into an interior air space. Both the front wall and the additional wall can contain sound attenuating material. The width of the passageway increases as it extends away from the annular air outlet.

27 Claims, 3 Drawing Sheets

FAN FOR AIR HANDLING SYSTEM

BACKGROUND OF THE INVENTION

This invention relates to fan units, particularly those designed for use in conjunction with an air handling system for a building or other structure.

Relatively inexpensive plenum or plug-type fans are well known in the industrial and commercial fan industry. They are commonly sold as an unhoused fan unit by the manufacturers although they are mounted in a suitable support structure that can include a front wall with an air inlet opening formed therein. These fans are used instead of or to replace centrifugal type fans which are commonly used in the air handling industry. The wheel of the plenum fan is used to pressurize a surrounding air plenum or housing in which the fan is installed. A number of air ducts can be connected to the housing and these can extend from any direction. In addition to being a reasonably inexpensive fan structure, a plenum or plug fan unit can save space by eliminating a special fan housing, transitions and diffusers as part of the air handling system. When required, two or more of these fans can be mounted side-by-side on common or separate support frames.

A common and well known difficulty of plug or plenum fans is that they can be inefficient in their operation and noisy compared to other types of fans. They can require considerably more electrical power for the operation of the one or more fans than more efficient units that produce the same amount of or more airflow. With respect to the noise problem, it is noted that with many known plug type fans, low frequency noises are generally produced and there is no currently available and practical solution to this noise problem.

U.S. Pat. No. 5,066,194 issued Nov. 19, 1991 to Carrier Corporation describes a fan orifice structure intended for use in conjunction with an outside enclosure, usually containing a heat exchanger and compressor of an air conditioner. The orifice is defined by an annular curved surface that extends downwardly from a top wall of the cover. The curved surface is generated by rotating a planar and curvilinear line about a coplanar axis of generation. It is said that the contour of the orifice enhances fan efficiency and reduces radiated noise. The orifice cover is made from plastic materials by a molding process.

U.S. Pat. No. 4,576,549 issued Mar. 18, 1986 to Garden City Fan & Blower Co. describes a centrifugal fan involving a fan wheel rotatably mounted in a scroll-spiral type housing having an axial air inlet and an air-outlet in a plane parallel to the axis of rotation. The air flow is drawn in axially by the fan-wheel from the housing air-inlet and is discharged peripherally therefrom into the housing structure to effect an enlarging spiral flow to a housing air-outlet. The fan-wheel comprises a series of circumferentially-spaced radially-extending blades fixed between a pair of axially spaced plates. The fan wheel in this patent specification, which is said to be of more or less conventional structure, comprises a pair of inner and outer plates secured in axially-spaced relationship by an annular series of radially-disposed vanes. The fan wheel is fixed to a shaft journalled on a suitable bearing on the side walls of the housing. This fan unit is equipped with an inlet-cone which is a concave annular member that tapers inwardly from the air inlet in the housing wall towards the fan wheel.

U.S. Pat. No. 4,900,225 issued Feb. 13, 1990 to Union Carbide Corporation teaches a centrifugal compressor having a two section diffuser which has a tapered section having a constant diffusing area along its radial length and a straight section having an increasing diffusing area along its radial length. Gases are drawn axially into the compressor which has an impeller wheel mounted on a rotatable shaft. The wheel, which has curved blades, serves to increase the velocity of the gas and to impart centrifugal force to the gas prior to entering into the diffuser.

U.S. Pat. No. 5,426,268 issued Jun. 20, 1995 to Yazici et al. describes both a fan inlet and a fan outlet structure for an air handling system. Both the fan inlet and the fan outlet have sound attenuating material arranged between interior and exterior walls. At least portions of the interior walls are constructed of perforated metal sheets. These known inlet and outlet units are constructed for use in association with a standard axial fan unit. In the outlet duct apparatus, the main passageway is substantially straight and increases in transverse cross-section from the inlet to the outlet. The transverse cross-section changes from circular at the end of the passageway adjacent the fan to rectangular at the opposite end.

It is an object of the present invention to provide a fan unit which is simple to build and construct and which employs a bladed fan wheel with an axial air intake and an annular air outlet and a fixed centerbody for directing airflow into and within the fan wheel.

It is a further object of the present invention, according to another aspect thereof, to provide a quieter air fan unit which employs a bladed fan wheel having an axial inlet and which is mounted in a housing having an air inlet in one side wall. This side wall and an additional wall spaced from the side wall and located in the housing extend radially away from the annular outlet to form an annular air passageway with sound reducing capabilities.

SUMMARY OF THE INVENTION

According to one aspect of the invention, a fan unit comprises a support structure including a front wall with an air inlet opening formed therein, and a bladed fan wheel rotatably mounted on the support structure about its central axis and having an axial air intake on a front side thereof confronting the inlet opening. The fan wheel has an annular air outlet extending about its circumference. A fixed centerbody for directing air flow into and within the fan wheel extends along the aforementioned central axis from a relatively narrow front end located in the air inlet opening to a wider rear end located within the fan wheel. The centerbody has an annular exterior surface that curves outwardly in a section thereof adjacent the wider rear end. The centerbody extends through the axial air intake of the fan wheel. One or more supporting devices connected to the centerbody rigidly support the centerbody in a fixed position in the air inlet opening.

Preferably the centerbody has a forward section which is bullet shaped and extends through the air inlet opening. The centerbody can be filled with sound attenuating material.

According to another aspect of the invention a fan unit comprises a housing,an inlet opening in the housing and a bladed fan wheel mounted within the housing for rotation about a central axis. The fan wheel has an axial air inlet on a front side thereof in alignment with the inlet opening and includes a rear plate and an annular outlet extending about its circumference. A drive shaft is rigidly connected to the rear plate and a motor is operatively connected to the drive shaft for rotating same. A generally elongate centerbody is rigidly connected by one or more struts to the housing. This centerbody extends from a relatively narrow front end axially along the central axis into the inlet opening in the housing and through the axial air inlet in the fan wheel. The center body has a wider rear end located within the fan wheel. A portion of the centerbody extending into the air inlet of the fan wheel has an annular, outwardly curved surface so that air drawn into the air inlet by rotation of the fan wheel is redirected by this surface of the centerbody in a radial direction towards the annular outlet.

According to a further aspect of the invention, an air fan unit comprises a housing including fixed sidewalls and a top, the housing forming an air plenum and having an interior air space, an air inlet in one of the sidewalls, and a bladed fan wheel mounted for rotational movement within the housing in order to pressurize the housing. The housing has two or more air outlet for connection to two or more air ducts. The fan wheel has an axial inlet confronting the air inlet in the housing and an annular outlet. An additional wall in the housing is spaced from the sidewall and the two walls extend radially away from the annular outlet forming an annular air passageway extending from the annular outlet and opening into the air space. The addition wall has wall edge extending along its periphery and substantial air gaps are form between two or more of the wall edges and the side walls and top of the housing so as to permit free flow of air into the plenum from the outlet of the fan wheel. At least the one sidewall and the additional wall contain sound attenuating material.

According to a still further aspect of the invention, an air fan unit comprises a support structure including a first wall, an air inlet opening formed in this first wall, and a bladed fan wheel mounted for rotational movement on the support structure. The fan wheel has an axial air inlet confronting the air inlet opening and includes an annular outlet extending about its circumference. An additional wall is spaced from the first wall and mounted on the support structure. An annular passageway is formed by the first wall and the additional wall and extends radially away from the annular outlet. The passageway is adapted to open into an air plenum of an air handling system. The width of the passageway increases as it extends away from the annular outlet whereby the velocity of airflow passing through the passageway decreases and the static air pressure increases as the airflow moves away from the annular outlet.

According to still another aspect of the invention, an air fan unit for an air handling system comprises a support structure including a generally planar wall with an inwardly converging air inlet opening formed therein, and a bladed fan wheel mounted on the support structure for rotation about a central axis. An annular curved lip extends around the air inlet opening and projects substantially outwardly from a planar front surface of the wall. This lip has a curved surface extending from the air inlet opening to the front surface of the wall. The wall contains sound attenuating material at least in an area surrounding the air inlet opening.

Preferably the curved lip is filled with sound attenuating material.

Further features and advantages will become apparent from the following detailed description of a preferred embodiment taken in conjunction with the accompanying drawings.

DETAILED DESCRIPTION OF PREFERRED EMBODIMENT

Figure 1:
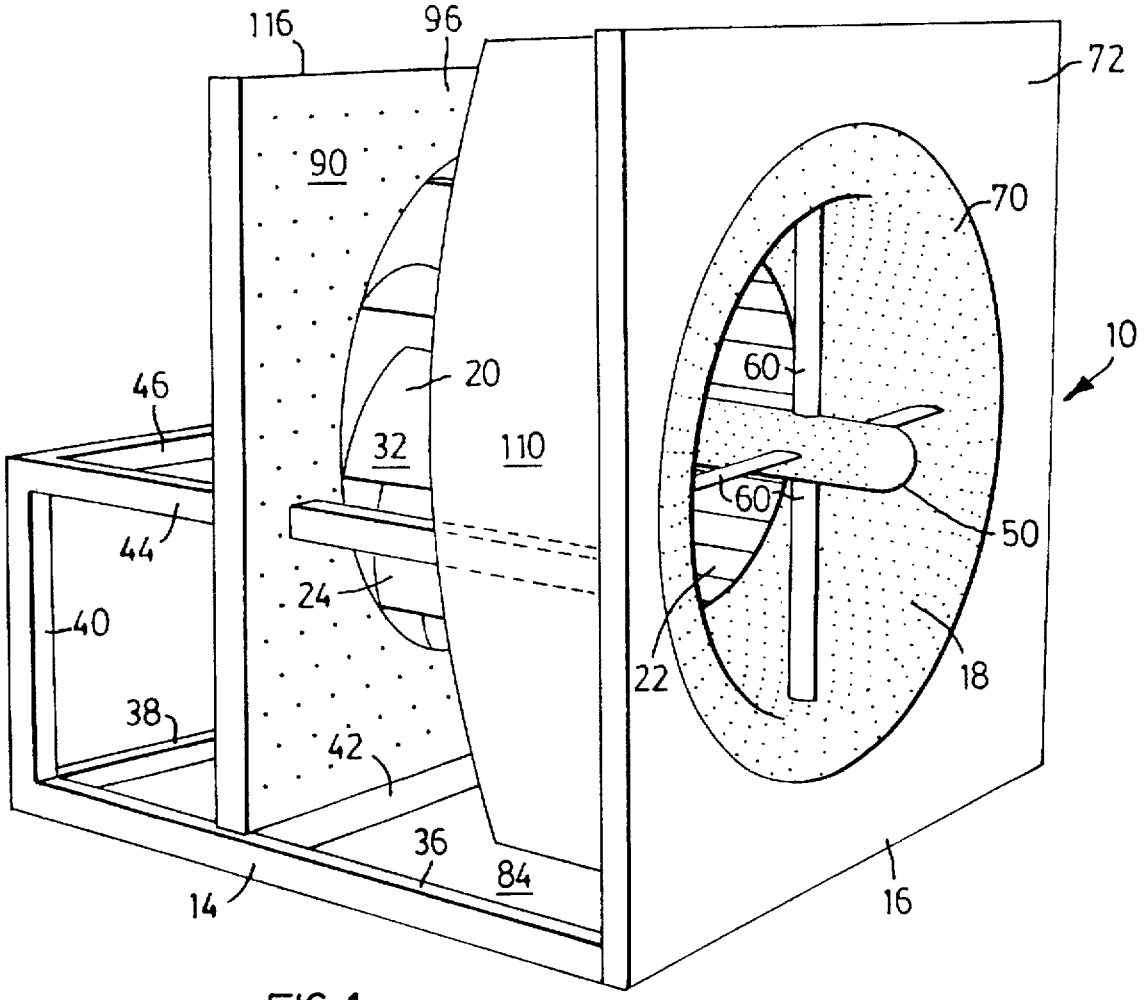
FIG. 1 is a perspective view of a plenum fan unit taken from the front and left sides and showing the front air inlet and a portion of the fan wheel.
Figure 2:
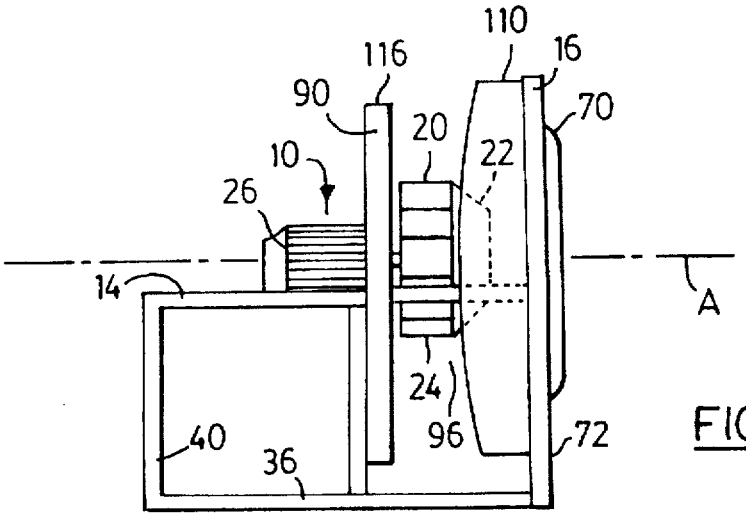
FIG. 2 is side elevation of the plenum fan unit of FIG. 1.
Figure 3:
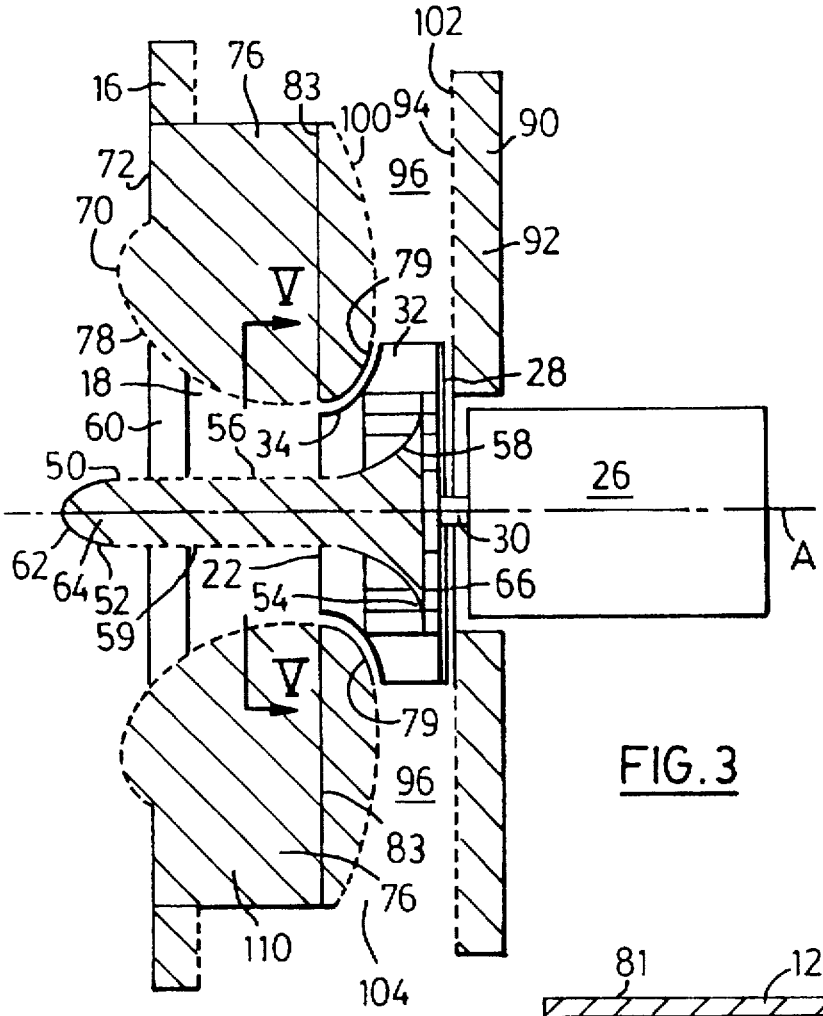
FIG. 3 is a schematic cross-sectional view taken through the axial center of the fan unit.
Figure 4:
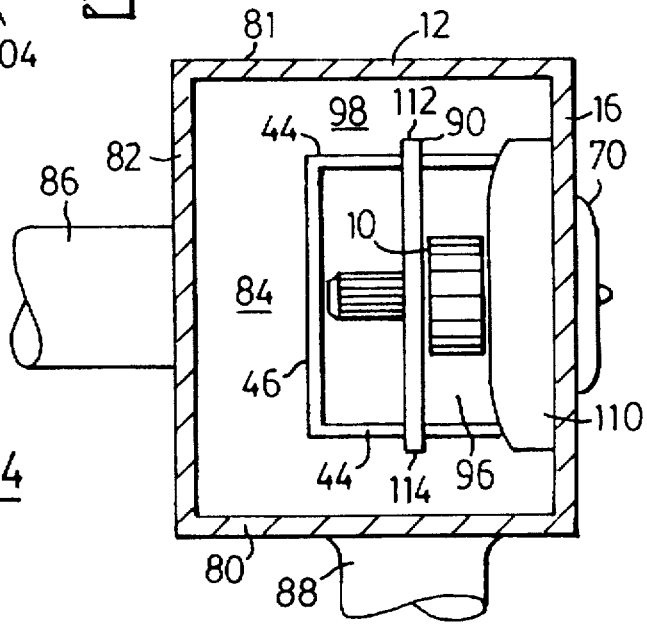
FIG. 4 is a schematic plan view, partly in section, illustrating the fan unit of FIG. 1 mounted in a plug fan cabinet whose top has been omitted for purposes of illustration.

FIGS. 1 and 2 illustrate a fan unit 10 suitable for use in an air handling system for a building or other large structure. As shown in FIGS. 1 and 2, the fan unit is an unhoused fan designed to be mounted or installed in a field erected or factory built housing or plenum 12 as illustrated in FIG. 4. The fan unit 10 comprises a support structure 14 which preferably includes a front wall 16 with an air inlet opening 18 formed therein. A bladed fan wheel 20 is rotatably mounted on the support structure 14. The wheel rotates about a central axis of rotation indicated at A in FIG. 2. The wheel has an axial air intake 22 on a front side thereof confronting the inlet opening 18. The fan wheel also has an annular air outlet 24 extending about its circumference. The wheel can be rotated by means of a suitable electric motor 26 which can be rigidly mounted on the support structure 14. As shown, the motor 26 can be mounted so as to provide direct drive to the fan wheel, rotary motion being provided to a rear, circular plate 28 of the fan wheel by means of drive shaft 30 (see FIG. 3). In a well known manner, it is also possible to have one or more continuous drive belts connect the drive shaft of the motor to one or more pulleys mounted on the drive shaft connected to the rear of the fan wheel.

Figure 6:
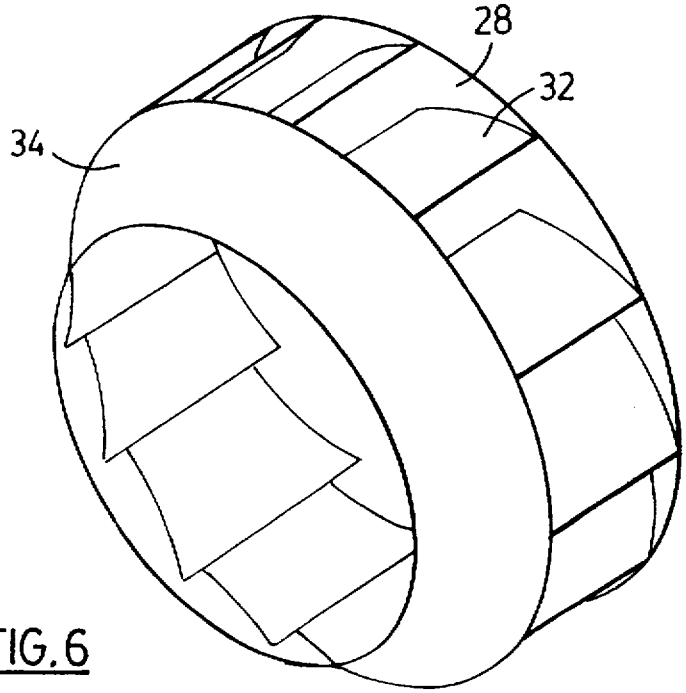
FIG. 6 is a perspective view of the fan wheel taken from the front and one side.

The fan wheel 20 can vary in diameter depending upon the particular air handling requirements and the air flow desired. In a known manner, the wheel 20 can be constructed using a number of high efficiency, airfoil blades 32, the general nature of which can be seen from FIG. 6. The rear edges of these blades are connected to the aforementioned rear plate 28 in a rigid manner, such as by welding while the forward edges are connected to an annular, outwardly curved plate 34. The preferred curvature of the plate 34 is shown in FIG. 3. The fan wheel and the complete rotating assembly are preferably dynamically balanced as a unit in a known manner.

The illustrated support structure 14 includes elongate, bottom frame members 36 and 38 and upright frame members 40. It will be understood that the frame members 36, 38 together with the bottom of front wall 16 form a rigid rectangular frame forming a base for the fan unit. If desired, there can be internal, bottom frame members such as the member 42 shown in FIG. 1. Preferably there is also an upper frame structure including side frame members 44 and rear horizontal frame member 46. The front end of the two frame members 44 can be connected to the front wall 16 in order to support same and to be supported thereby.

Figure 5:
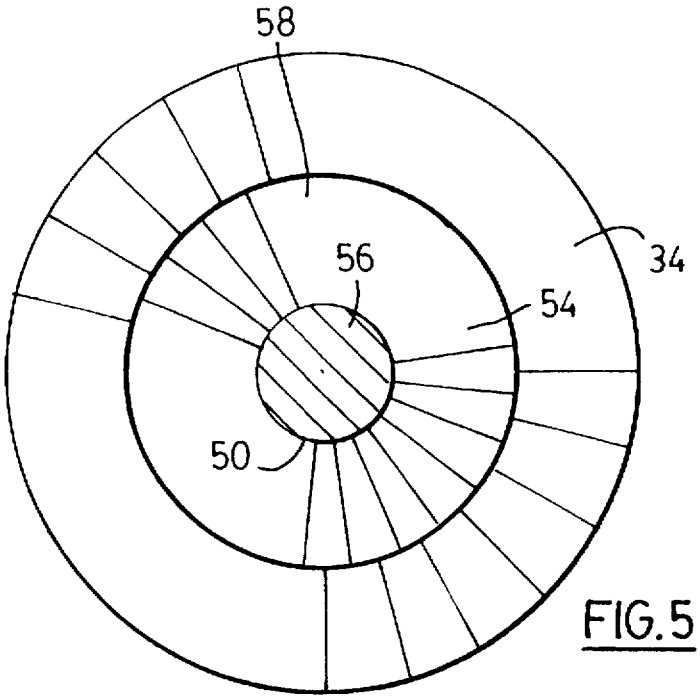
FIG. 5 is a cross-sectional elevation taken along the line V—V of FIG. 3 and showing the front of the fan wheel and a rear portion of a fixed centerbody mounted therein.

A fixed center body 50 for directing air flow to and within the fan wheel 20 extends along the central axis A from a relatively narrow front end indicated at 52 located in the air inlet opening 18 to a wider rear end 54 located within the fan wheel 20. As illustrated in FIG. 3, the rear end 54 preferably extends substantially to the back of the fan wheel, close to the rear plate 28. The centerbody 50 has an annular exterior surface indicated at 56 in FIG. 5 and this surface curves outwardly in a section 58 adjacent the wider rear end 54. The centerbody 50 extends through the axial air intake 22 of the fan wheel. One or more supporting devices are connected to the centerbody 50 for rigidly supporting it in a fixed position in the air inlet opening 18. As illustrated, these supporting devices comprise four rigid struts 60 that extend in the shape of a cross from the forward section of the centerbody.

The preferred centerbody has a forward section which is bullet shaped and extends through the air inlet opening 18. This forward section has an aerodynamic, rounded nose 62 made of solid (unperforated) sheet metal. Preferably, the centerbody is filled with sound attenuating material 64 to help reduce the amount of noise generated by the operation of the fan wheel. A standard fibreglass acoustical filler can be used to fill the centerbody, which material is compressed to some extent so that it will completely fill the interior of the centerbody and have good sound absorbing capabilities. In a particularly preferred embodiment, a relatively thin layer, for example one half inch or less, of a fibreglass insulation with a cloth backing can be used along the interior surface of the metal shell which forms the exterior of the centerbody 50. This preferred material, which per se is known in the air handling art, has zero erosion of the fibreglass insulation at air velocities up to 6000 ft per minute. The standard low density acoustical filler is then placed behind the zero erosion layer. In the preferred embodiment the metal shell of the centerbody 62 is formed of perforated sheet metal in the cylindrical, central region 59 thereof indicated in dashed lines in FIG. 3. The circular rear plate 66 of the centerbody can be made of either perforated or solid metal sheet. The outwardly curved section 58 of the centerbody is made of solid metal sheet like the nose 62.

It will be understood that the centerbody 50 helps to guide the airflow through air inlet opening 18 and helps to avoid undesirable turbulence in the opening. In addition, the efficiency of the fan wheel 20 is increased because the solid, curved rear end section 58 redirects the air flow in a radial direction towards the annular outlet 24. Thus, the air flow in the fan wheel itself is relatively smooth.

Another feature of the fan unit 10 is the use of an annular curved lip 70 that extends around the air inlet opening 18 as illustrated clearly in FIGS. 1 and 3. The lip projects substantially outwardly from a planar front surface 72 of the aforementioned front wall 16. The lip has a curved surface that extends from the air inlet opening 18 to the front surface 72. The wall 16 contains sound attenuating material 76, of the type described above, at least in an area surrounding the air inlet opening 18. Preferably the curved lip 70 itself is filled with sound attenuating material as indicated in FIG. 3. Also preferably both the air inlet opening 18 and the curved lip 70 are formed with perforated sheet metal 78 as indicated by the dashed lines in FIG. 3. The provision of the annular curved lip 70 acts to reduce noise that would otherwise be caused by air flowing into the fan unit 10 during operation thereof. It is also possible to form the surface of the lip with solid metal sheet although the use of such is less desirable from the standpoint of sound attenuation.

An annular surface section 79 of the front wall around the inlet opening 18 is made of solid metal sheet. The section 79 is adjacent the curved plate 34 of the fan wheel. In addition there is an internal, solid plate partition 83 mounted within the thick portion of the wall 16. This partition can extend outwardly from the front edge of the section 79 and is parallel to the front of wall 16. The internal partition helps to develop the desired pressure levels in the preferred fan unit of the invention.

The amount of noise emanating from the front side of the doubled walled housing 12 can be further reduced by filling the interior of front wall 16 with the aforementioned sound attenuating material. Indeed, all four walls of the housing or plenum 12 indicated at 16, 80, 81 and 82 in FIG. 4 can be filled with sound attenuating material to reduce the amount of noise coming from the interior of the housing. The interior surfaces of the double walls 16, 80 to 82 can be made with perforated metal sheet mounted on suitable, known framing material while the exterior surfaces are solid metal sheets. The construction of the plenum or housing 12 for a plug fan is well known in the art and therefore a detailed description herein is not required. It will be appreciated that the housing 12 will be enclosed at the top and the bottom. The bottom can be formed by the floor 84 of the structure or building in which the fan unit 10 is installed. Because the housing 10 is completely enclosed except for the air inlet opening 18 and the air ducts, such as ducts 86 and 88 shown in FIG. 4, the fan wheel 20 is able to pressurize the surrounding air plenum (that is the interior of the housing 12) in which the fan is installed. It will be appreciated that with this arrangement, the required air ducts can be connected to the housing 12 from any direction, which can result in space savings and construction versatility.

Preferably, in a known manner, the air inlet opening 18 includes an inwardly converging portion that can extend substantially to the axial air intake 22 of the fan wheel. This inlet arrangement helps to funnel the required amount of air into the fan wheel and the combination of the inwardly converging inlet and the curved lip 70 creates a smooth air flow into the fan wheel. The provision of the lip 70 results in a much greater curved surface in a radial plane taken through the central axis indicated at A.

Another preferred feature of the fan unit 10 is the provision of an additional wall 90 which, when the fan unit is installed, is located in the housing 12 and is spaced from the fixed side wall or front wall 16. The additional wall 90 can be rigidly mounted on the support structure 14 in any suitable manner. Preferably the wall 90 is filled with the aforementioned sound attenuating material, which material is indicated at 92. Also, preferably the front surface 94 of the wall 90 is made of perforated metal sheet material.

The front or side wall 16 and the additional wall 90 extend radially away from the annular outlet 24, forming an annular air passageway 96 extending around the annular outlet and opening into the interior air space 98 of the housing 12. Preferably the opposing surfaces 100 and 102 of the front wall and the additional wall 90 diverge with respect to each other as they extend radially away from the annular outlet 24. In this way, a diffuser is formed around the fan wheel which extends out from the air outlet 24. The provision of this diffuser results in greater fan efficiency as compared to prior art plug fans wherein the air flow from the fan simply empties into a relatively large air plenum or housing. The increased efficiency of the fan unit 10 arises from the reduction in the velocity of the air at exit point 104 of the diffuser. It will be appreciated that the velocity of the air at the point 104 will be substantially less than the velocity of the air as it exits the blades of the fan wheel. As will be appreciated by those skilled in the construction of air fans, not only does the velocity of the air flow decrease as the air passes through the passageway 96, the air pressure increases as the air flow moves away from the annular outlet 24. In other words, static pressure recovery (static regain) from the velocity pressure is substantially improved by the provision of the diffuser.

In the preferred embodiment illustrated in FIGS. 2 and 3, the additional wall 90 is generally flat, at least on its front side, while the preferred front or side wall 16 is inclined at a slight angle away from the wall 90 as the walls extend radially away from the annular outlet 24. It is also possible for the diffuser to be constructed so that the opposing surfaces 100 and 102 are parallel to each other (not shown). Also, as shown in the drawings, the front or side wall 16 can be formed with a much thicker section 110 in the region around the air inlet opening 18. By making the front wall thicker in this region, the length of the air inlet opening 18 can be increased along with the amount of sound attenuating material 76 around the inlet opening. Although the thickness of section 110 can vary, depending on the size of the fan unit, etc., typically its thickness is at least about 12 inches. Generally, its thickness would be in the 12 to 18 inches range. It should also be noted that the side edges 112 and 114 as well as the top 116 of the wall 90 should be sufficiently spaced from the adjacent walls of the housing 12 to permit the air flow from the fan wheel to flow easily and unrestricted into all of the interior space of the plenum after exiting the passageway 96. There should be an air gap on at least two edges of the wall 90 and preferably an air gap is provided along all four edges of the wall. In many housings however, particularly for larger fans, there is a gap on only three sides with no gap at the bottom of wall 90 due to the need to mount and support the fan unit near the bottom of the housing. The size of the gap is simply a matter of engineering design that depends on such factors as providing a reasonable flow velocity, i.e. 1000 cfm through the diffuser section of the fan unit. In a preferred embodiment the gap provided is at least two feet.

Although the fan wheel is illustrated as being only supported by a drive shaft extending rearwardly therefrom, it will be appreciated by those skilled in the art that the fan wheel 20 can be supported by a central drive shaft that extends into and even through the centerbody 50 so that the fan wheel is supported at both its rear end and at the front. For example, a suitable shaft bearing could be mounted inside the centerbody 50 to support the front end of the drive shaft for the fan wheel. The features of the present invention, and in particular the use of the centerbody 50, lend themselves to all standard plug fan arrangements, including standard arrangements for driving the fan wheel.

It will be appreciated by those skilled in the art that various modifications and changes can be made to the described and illustrated fan unit and to the illustrated housing without departing from the spirit and scope of this invention. Accordingly, all such modifications and changes as fall within the scope of the appended claims are intended to be part of this invention.

I therefore claim:

1. A fan unit comprising:

a support structure including a front wall with an air inlet opening formed therein;

a bladed fan wheel mounted on said support structure for rotation about its central axis and having an axial air intake on a front side thereof confronting said inlet opening, said fan wheel having an annular air outlet extending about its circumference;

a fixed centerbody for directing air flow into and within said fan wheel extending along said central axis from a relatively narrow front end located in said air inlet opening to a wider rear end located within said fan wheel, said centerbody having an annular exterior surface that curves outwardly in a section thereof adjacent said wider rear end, said centerbody extending through said axial air intake of the fan wheel; and one or more supporting devices connected to said centerbody for rigidly supporting said centerbody in a fixed position in said air inlet opening.

2. A fan unit according to claim 1 wherein said centerbody has a forward section which is bullet shaped and extends through said air inlet opening.

3. A fan unit according to claim 1 wherein said centerbody is filled with sound attenuating material.

4. A fan unit according to claim 1 wherein said one or more supporting devices include a plurality of struts rigidly fixed to said centerbody, said struts extending outwardly from said centerbody and being rigidly attached to said front wall.

5. A fan unit according to claim 1 wherein said air inlet opening includes an inwardly converging portion that extends substantially to said axial air intake of the fan wheel.

6. A fan unit according to claim 5 wherein said air inlet opening has an annular curved lip that extends forwardly beyond a front surface of said front wall, said curved lip acting to reduce noise caused by air flowing into said fan unit during operation thereof.

7. A fan unit according to claim 5 wherein sound attenuating material fills said front wall at least in an area around said inwardly converging portion.

8. A fan unit according to claim 1 including an electrical motor for rotating said fan wheel, said motor being mounted on said support structure and having an output shaft connected to said fan wheel at a rear side of the fan wheel.

9. A fan unit according to claim 8 wherein said wider rear end of the centerbody is located near said rear side of the fan wheel.

10. A fan unit comprising:

a housing;

an inlet opening formed in said housing;

a bladed fan wheel mounted within said housing for rotation about the bladed fan wheel's central axis, said fan wheel having an axial air inlet on a front side thereof in alignment with said inlet opening and including a rear plate and an annular outlet extending about the bladed fan wheel's circumference;

a drive shaft rigidly connected to said rear plate;

a motor operatively connected to said drive shaft for rotating said drive shaft; and a generally elongate center body rigidly connected by one or more struts to said housing, said center body extending from a relatively narrow front end axially along said central axis into said inlet opening in the housing and through said axial air inlet in the fan wheel, said center body having a wider rear end located within said fan wheel, wherein a portion of said center body extending into said axial air inlet of the fan wheel and adjacent said wider rear end has annular, outwardly curved surface and air that is drawn into said axial air inlet by rotation of said fan wheel is redirected by said surface of said center body in a radial direction toward said annular outlet.

11. A fan unit according to claim 10 wherein said centerbody is filled with a sound attenuating material.

12. A fan unit according to claim 10 wherein said inlet opening is formed in a wall of said housing and is inwardly converging towards the fan wheel.

13. A fan unit according to claim 12 wherein an outwardly extending annular curved lip is formed around said inlet opening, whereby said curved lip reduces noise caused by air flowing into said fan unit during use thereof.

14. A fan unit according to claim 12 wherein said housing includes a fixed front sidewall in which said inlet opening is formed and said front sidewall and an interior wall mounted in said housing extend radially away from said annular outlet, thereby providing an annular passageway for air exiting said annular outlet, both said front sidewall and said interior wall containing sound attenuating material.

15. A fan unit according to claim 14 wherein the width of said passageway increases as it extends radially away from said annular outlet, the velocity of the air in said passageway decreasing and the static pressure of said air increasing as said air moves away from said annular outlet.

16. A plug air fan unit comprising:

a housing including fixed sidewalls and a top, said housing forming an air plenum adapted to be pressurized by a bladed fan wheel and having an interior air space, said housing having two or more air outlet for connection to two or more air ducts;

an air inlet in one of said sidewalls;

said fan wheel mounted for rotational movement within said housing in order to pressurize said housing, said fan wheel having an axial inlet confronting said air inlet in the housing and an annular outlet; and an additional wall in said housing spaced from said one sidewall and having wall edges extending along its periphery, substantial air gaps being formed between two or more of said wall edges and said sidewalls and said top of said housing so as to permit free flow of air into said air plenum from the outlet of the fan wheel;

said one sidewall and said additional side wall extending radially away from said annular outlet and located on opposite sides of said annular outlet, said one sidewall and the additional wall forming an annular air passageway extending from said annular outlet and opening into said air space, wherein at least said one sidewall and said additional wall contain sound attenuating material.

17. An air fan unit according to claim 16 wherein opposing surfaces of said one sidewall and said additional wall diverge with respect to each other as they extend radially away from said annular outlet.

18. An air fan unit according to claim 17 wherein said additional wall is a generally flat, interior wall and one sidewall is inclined away from said additional wall as said one sidewall and said additional wall extend radially away from said annular outlet.

19. An air fan unit according to claim 16 wherein said one sidewall and said additional wall have opposing surfaces which are each formed from perforated sheet metal.

20. An air fan unit comprising:

a support structure including a first wall;

an air inlet opening formed in said first wall;

a bladed fan wheel mounted for rotational movement on said support structure, said fan wheel having an axial air inlet confronting said air inlet opening and an annular outlet extending about its circumference;

an additional wall spaced from said first wall and mounted on said support structure; and an annular passageway formed by said first wall and said additional wall and extending radially away from said annular outlet, said passageway being adapted to open into an air plenum of an air handling system, wherein the width of said passageway increases as it extends away from said annular outlet, the velocity of airflow passing through said passageway decreasing and the static air pressure increasing as the airflow moves away from said annular outlet.

21. An air fan unit according to claim 20 wherein said additional wall is generally flat and said first wall is inclined away from said additional wall as said first wall and said additional wall extend radially away from said annular outlet.

22. An air fan unit according to claim 20 wherein opposing surfaces of said first wall and said additional wall are each formed from perforated sheet metal.

23. An air fan unit according to claim 22 wherein each of said first wall and said additional wall are filled with sound attenuating material.

24. An air fan unit according to claim 20 wherein said support structure is a double walled, insulated housing comprising a number of sound insulated sidewalls, including said first wall and a top wall, said housing forming said air plenum which is capable of being pressurized by said fan wheel.

25. An air fan unit for an air handling system comprising:

a support structue including a generally planar wall with an inwardly converging air inlet opening formed therein;

a blade fan wheel mounted on said support structure for rotation about a central axis and having an axial air intake on a front side thereof confronting said inlet opening, said fan wheel having an annular, circumferential air outlet; and an annular curved lip extending around said air inlet opening and projecting substantially outwardly from a planar front surface of said wall, said lip being filled with sound attenuating material and having a curved surface extending from said air inlet opening to said front surface of the wall, wherein said wall contains sound attenuating material at least in an area surrounding said air inlet opening;

said fan unit further include an elongate centerbody rigidly mounted in the center of said air inlet opening and coaxial with said fan wheel, said centerbody being filled with sound attenuating material and directing air flow through said air inlet opening.

26. An air fan unit according to claim 25 wherein both said air inlet opening and said curved lip are formed with perforated sheet metal.

27. An air fan unit for an air handling system comprising:

a support structure including a generally planar wall with an inwardly converging air inlet opening formed therein;

a bladed fan wheel mounted on said support structure for rotation about a central axis and having an axial air intake on a front side thereof confronting said inlet opening, said fan wheel having an annular, circumferential air outlet; and an annular curved lip extending around said air inlet opening and projecting substantially outwardly from a planar front surface of said wall, said lip having a curved surface extending from said air inlet opening to said front surface of the wall; and an elongate centerbody rigidly mounted in the center of said air inlet opening and coaxial with said fan wheel, said centerbody being filled with sound attenuating material and directing air flow through said air inlet opening, wherein said wall contains sound attenuating material at least in the area surrounding said air inlet opening.

* * * * *